US005680719A

United States Patent [19]

Poser

[11] Patent Number: 5,680,719

[45] Date of Patent: Oct. 28, 1997

[54] DISPLAY SIGN EQUIPPED WITH ADJUSTABLE ALPHANUMERIC INDICIA

[76] Inventor: Harold A. Poser, W5804 Hickory Point Ct., Onalaska, Wis. 54650

[21] Appl. No.: 491,271

[22] Filed: Jun. 6, 1995

[51] Int. Cl.[6] ..... G09F 3/04

[52] U.S. Cl. ..... 40/450; 40/593

[58] Field of Search ..... 160/370.21; 248/208; 40/450, 595, 593

[56] References Cited

U.S. PATENT DOCUMENTS

| | | | |
|---|---|---|---|
| 810,604 | 1/1906 | Baier | 248/208 |
| 1,635,420 | 7/1927 | Johnson . | |
| 1,848,296 | 3/1932 | Hueber . | |
| 1,933,013 | 10/1933 | Hamilton . | |
| 1,971,738 | 8/1934 | Wenar . | |
| 2,025,161 | 12/1935 | Franklin | 248/208 |
| 2,229,012 | 1/1941 | Geyzer . | |
| 2,329,645 | 9/1943 | Panzetta | 40/530 X |
| 2,821,039 | 1/1958 | Nash et al. . | |
| 2,902,241 | 9/1959 | Spitko | 248/208 |
| 3,481,060 | 12/1969 | Hartz | 40/591 X |
| 3,496,665 | 2/1970 | Goldman . | |
| 3,496,666 | 2/1970 | Morley | 40/591 |
| 4,132,022 | 1/1979 | Wood, Jr. | 40/591 |
| 4,208,820 | 6/1980 | Cole | 40/591 |
| 4,470,214 | 9/1984 | Kinloch | 40/593 |
| 4,583,312 | 4/1986 | King et al. | 40/450 X |
| 4,777,747 | 10/1988 | Murray, Jr. | 40/450 X |
| 4,858,357 | 8/1989 | Thorn | 40/584 X |
| 4,929,014 | 5/1990 | Clark et al. | 160/320.21 X |
| 5,100,194 | 3/1992 | Decker | 160/370.21 X |
| 5,463,827 | 11/1995 | Williams | 40/593 X |

*Primary Examiner*—Joanne Silbermann
*Attorney, Agent, or Firm*—M. Paul Hendrickson

[57] ABSTRACT

The present invention provides a display sign for displaying diverse alphanumeric representations of a figure eight configuration within a windshield of a motorized transport, such as a car or truck. The sign permits a variety of sales information to be displayed and easily changed. The sign is made of a flexible panel conformable to the shape of the windshield. The flexible panel is resilient so as to return to its original shape when taken out of the windshield. The sign may be biased against the windshield with a wedge or biasing bar using a dashboard, rearview mirror and sun visors as anchoring points for biasing.

10 Claims, 6 Drawing Sheets

DISPLAY SIGN EQUIPPED WITH ADJUSTABLE ALPHANUMERIC INDICIA

FIELD OF THE INVENTION

The present invention relates to display signs and more particularly to a display sign having alterable indicia and the method for using the same.

BACKGROUND OF THE INVENTION

It is customary amongst automotive, boat, recreational vehicle, track, topper, and farm implement dealers to maintain large lots for displaying new and used retail goods. It is also common practice amongst such dealers to post in large print noteworthy saleable features so passersby may be attracted to the sale item.

The problems associated with the need for large signs communicating sales information to consumers is probably best illustrated by the used car trade. Unlike new car dealers where the inventory is similar, used car dealers often maintain a large diverse inventory of used cars upon large sale lots. Every vehicle is different and needs an individual sales message. The dealers need to promote the best features of each vehicle: sales price, mileage, monthly payments, interest rate, year, make, etc.

One prevalent practice involves professionally painting sales information onto an exterior window of the vehicle. Such an exterior paint must necessarily survive inclimatic conditions and therefore be durable against weathering. All states require the vehicular windows be free from any view obstructing markings when road testing the vehicle. This requires paint removal (usually by scraping) before road use and then reapplying the painted message when the vehicle is returned to the lot for sale. In the northern climates, painting is impractical during the winter months since most paints require a relatively warm painting temperature as well as a clean and dry surface so as to permit the paint to adequately wet, adhere and dry usually upon the windowed surface. The need in the northern climates to frequently remove ice and snow from the windowed surface by scraping also leads to inadvertent removal of the painted message. Exteriorly painted windows are also occasionally susceptible to defacing by vandals.

Another common practice involves affixing individual whole numbers or letters adhesive lettering or decals directly on a prominent vehicular surface such as to a windshield. As similar to painted signs, view obstructing decals must also be removed before each test drive or road use and then reapplied with fresh decals to post the desired sales message when the vehicle is returned to the lot. Decals are relatively expensive, difficult to apply and difficult to remove. Inventory must be kept in the showroom. Decals are typically used sparingly by the dealers to indicate vehicular year or other short message. Salespersons are generally reluctant to allow indiscriminate test drives of a vehicle with painted or decaled messages because of expenses and labor required to remove and replace the sign message.

Although there has long existed a need to devise a better system for displaying sales information, the used car lot sign practices have remained relatively unchanged for the past several decades. U.S. Pat. No. 3,496,665 by Goldman proposed a sign equipped with hundreds of flexible cards bearing a single numeral or letter. When posting a sale price or other sales message, the user of the Goldman sign would need to search through the stacked cards to find the appropriate lettering or numbering display and then post it upon the sign. Retaining the cards in a convenient place and position for display presents a rather cumbersome display and tedious procedure especially each time a new sign message is required. The sign allowed only for the "was" and "now" pricing.

In U.S. Pat. No. 4,858,357 to Thorn, there is disclosed a sign for displaying and changing alphanumeric information using the seven segments for forming a figure 8 configuration of a contrasting coloring. The segments are of a permanent contrasting coloring to the background member. By appropriately marking or inking the segments with an erasable ink marker (e.g. water-soluble ink) which matches the background member color, a complete alphanumeric display of all ten digits as well as the complete English alphabet is possible through use of the seven segments of the figure 8 in block form. Thus, by coloring certain segments of each Figure 8 representation with an erasable ink of a color matching the background field, the posted message upon the sign may be changed as desired. The sign and its reuse depends upon covering and removing an erasable ink from the segments. An inherent limitation of the sign is that it requires the tedious and untidy filling of blank areas by a pen. The applicability is also generally limited to small signs since the uniform blocking of large areas necessitates a specially made, broad pointed pen.

There exists a need for an economical advertising device which may be readily changed to reflect a wide variety of sales information. The need is well illustrated by the need for more effective signs to retail uniquely diverse goods such as new and used automobiles. Reusable signs which would be large enough for a passerby to readily observe the sales information while allowing any salesperson to readily change the sign to reflect new sales information would be particularly beneficial to the vehicular trade. Large, changeable signs protectable against weathering and vandalism would afford substantial cost savings to its users. A sign which could be easily displayed and removed from display for vehicular road use without necessitating costly restoration expenses such as repainting or redecaling would save considerable time, effort and expense to vehicular dealers. The signs may be repeatable reused without causing environmental waste.

DETAILED DESCRIPTION OF THE INVENTION

Figure 7:
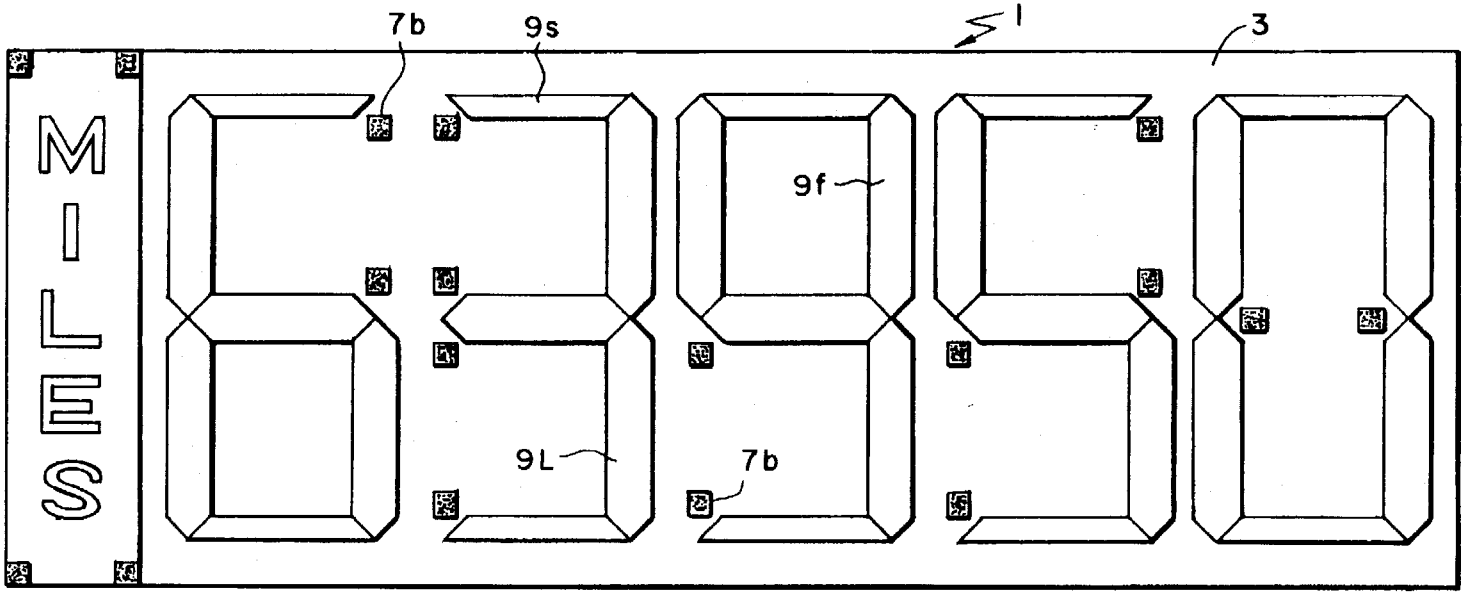
FIG. 7 is a frontal view of the display sign shown in FIG. 1 with a posted message attached.
Figure 8:
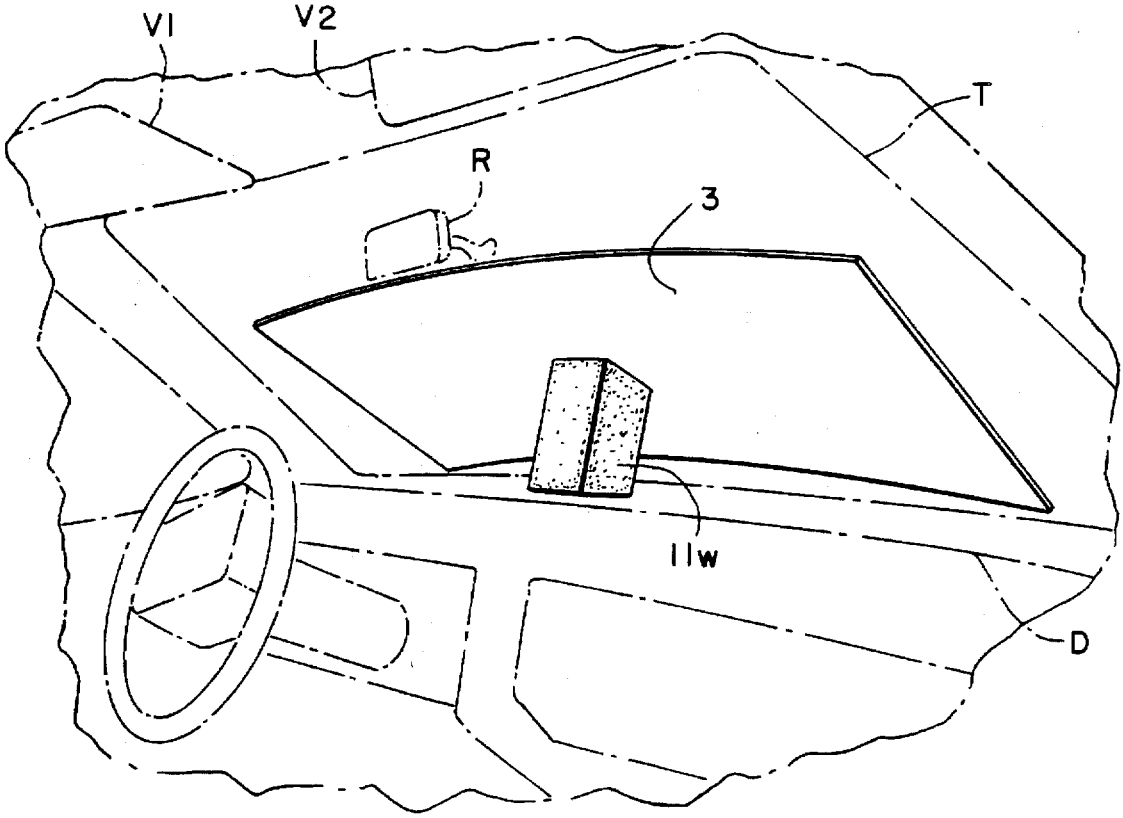
FIG. 8 depicts a rear view of the display sign of FIG. 1 biased against an automotive windshield with the wedge block.
Figure 9:
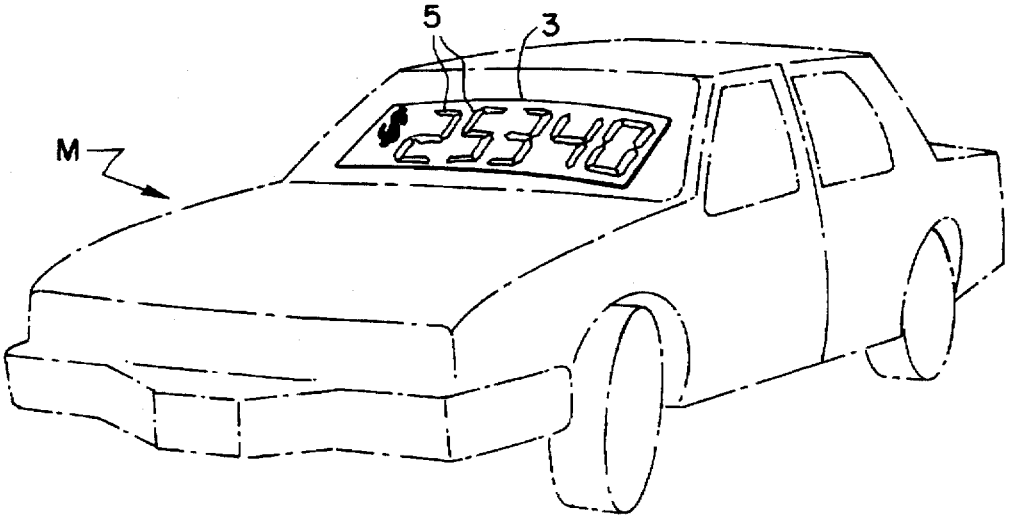
FIG. 9 depicts a frontal view of the display sign depicted in FIG. 8.
Figure 10:
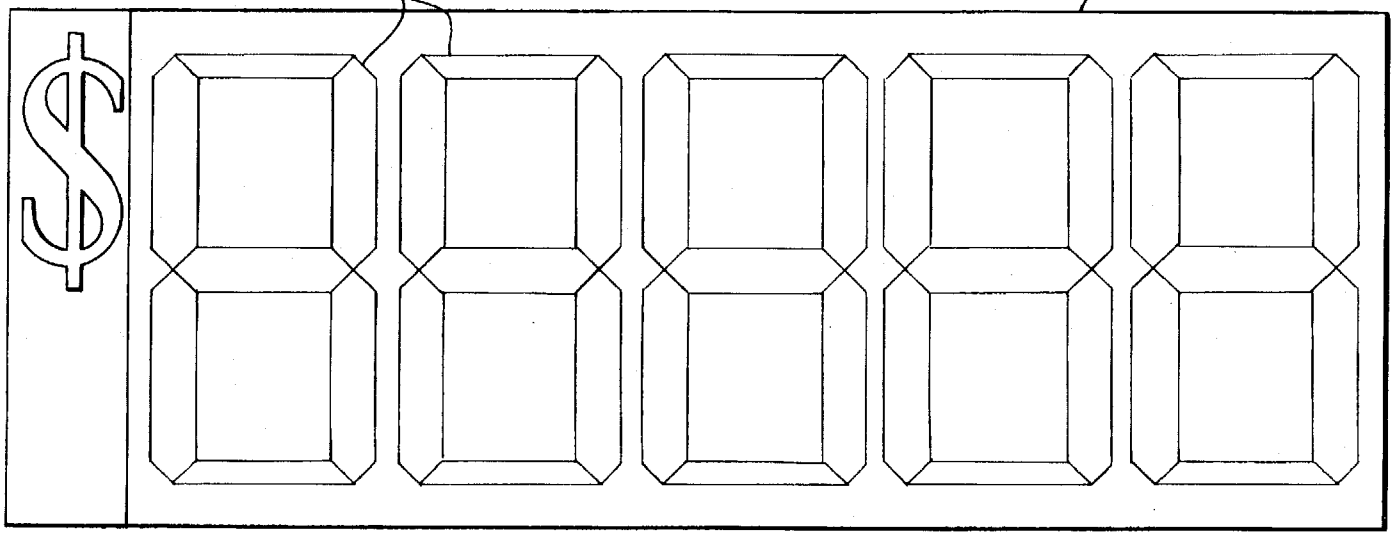
FIG. 10 is a frontal view of display sign 1.

Pursuant to the present invention, there is provided a sign (generally designated as 1) equipped with alphanumeric marking units 9 (generally designated as 9) which may be altered to change a posted message. The sign 1 comprises a resilient background member 3 conformable to a curvature of a transparent surface T, a number of alphanumeric representations 5 facially positioned upon the background member 3 with each representation of said representations 5 being arranged upon member 3 to provide an alphanumeric guideline in a figure 8 configuration for posting marking units 9 thereupon, affixing means (generally designated as 7) for securing the alphanumeric marking units 9 to the representations 5 and biasing means (generally designated as 11) for biasing the background member 3 to the curvature of the transparent surface T. A message (as shown in FIGS. 7, 9, and 10) comprises a multiplicity of the segmented marking units 9 which are of a contrasting color to said background member 3 and are equipped for separate emplacement by the fastening means 7 onto representations 5, with each of said unit 9 forming a legged segment of the figure 8 configuration when affixed to said alphanumeric representations 5. Illustrative biasing means 11 for conforming background member 3 to the contour or curvature of transparent surface T include a biasing member such as a resilient biasing wedge 11*w* and a flexible biasing bar 11*b* as depicted in the drawings. One or more of the biasing members 11 may be effectively used to bias panel 3.

Sign 1 includes a combination of cooperative components which can be effectively utilized to properly position the display sign 1 and the desired posted message substantially flush against the windshield T. An inability to properly position sign 1 in juxtaposition to the window T can result in distortion of the message as well as causing glare, reflection, obliteration, obscurity, etc. of the posted message. The cooperative relationship of the components renders the display device 1 particularly well-adapted for protectively and properly displaying the posted message within a passenger cabin against a windshield T of a vehicle by supporting the sign 1 upon the dashboard D and biasing it against an inside surface windshield T of a motorized transport M (e.g. such as an automobile) as particularly illustrated by FIGS. 8 and 9. The undistorted message of sign 1 may be readily observed at great distances and at fast vehicular speeds by passing viewers.

The background member 3 in cooperative association with the biasing means 11 permits the message to be properly posted at an appropriate position against windshield T. The background member 3 is suitably constructed of a supportive material possessing sufficient flexibility so as to permit member 3 to conform to a curved windshield T surface when it is pulled or biased against the windshield T by the conforming means 11. The background member 3 advantageously possesses sufficient resiliency so that it will return to its original planar shape when the biasing or conforming force such as the force exerted by wedge 11*w* or wedging bar 11*b* is removed from anchoring site in juxtapositional to dashboard D. Plastic panel members 3 sized so as to fit against a contoured windshield T of an automobile M and constructed of relatively firm but flexible plastic materials which bends when subjected to a biasing pressure (e.g. such as by biasing with wedge 11*w* or biasing bar 11*b* towards curved windshield T) and yet flexible enough to return to an unbent form or relaxed planar state upon relaxation of the biasing force are particularly well-suited for this purpose. These flexible and resilient attributes also contribute towards protecting an automotive interior against damage. Panel 3 is most preferably of a solid or single coloring which provides a contrasting coloring to marking units 9. The use of light colored background for the background member 3 and a bright, fluorescent or reflective coloring for the marking units 9 provides a particularly decipherable and attention attracting sign 1.

The panel member 3 and the other sign components which directly contact onto the vehicular interior are advantageously constructed of polymeric materials such as those derived from thermoplastic and thermoset polymers of a natural (e.g. rubbers, etc.) and synthetic origin. Illustrative polymeric materials include the polymerizates (e.g. homopolymers and copolymers) of vinyl aromatics (e.g the styrenes and the halostyrenes such as chlorostyrene, 2,5-dichlorostyrene, etc); esters of the alpha-beta ethylenically unsaturated carboxylic acids (e.g. the methacrylate and the acrylate esters of methyl, ethyl, isopropyl, and the alpha-n-butyl); ethylenically unsaturated carboxylic acid monomers (e.g. acrylic, methacrylic, itaconic, fumaric, maleic, crotonic and esters); the acrylonitriles and methacrylonitriles; the polyurethanes (e.g. condensation products of organic polyisocynate and a polyhydric such as 1,4 butanediol and/or polyhydric polyoxakylena others such as the polyethylene and polypropylene either glycols); acrylamide and methacrylamides; vinyl acetate and related monomers (e.g. acrylate, methacrylate, etc.); the vinyl halides (e.g. vinyl chloride, vinyl bromide); vinylidene halides (e.g. bromide, chloride); mono and diethylenically unsaturated hydrocarbons (e.g. ethylene, propylene, isobutylene, isoprene, butadiene, etc.); mixtures thereof and the like. The polyolefines (e.g. polyethylene, polypropylene, etc.), the polyesters, polyvinyl chlorides, polyvinylidene chlorides are illustrative of thermoplastic materials which may be compounded so as to possess sufficient structural strength and flexibility for use in fabricating member 3. Thermoplastics of the polyolefines (e.g. polyethylene and especially polypropylene) are particularly well suited for use in the fabrication of panel member 3. A corrugated polyproplylene product distributed under the "Diversi Plast" trademark, by an LDI company, 7425 Laurel Ave., Minneapolis, Minn. 55426 and characterized as 240# MSF and 5.0 mm thickness is especially well suited for fabricating background member 3. Such corrugated polypropylenes are manufactured in large panel sheets which, when cut to a 46"×15.62" size, will provide an appropriate sized panel member 3 well suited for the posting of messages thereupon.

Figure 5:
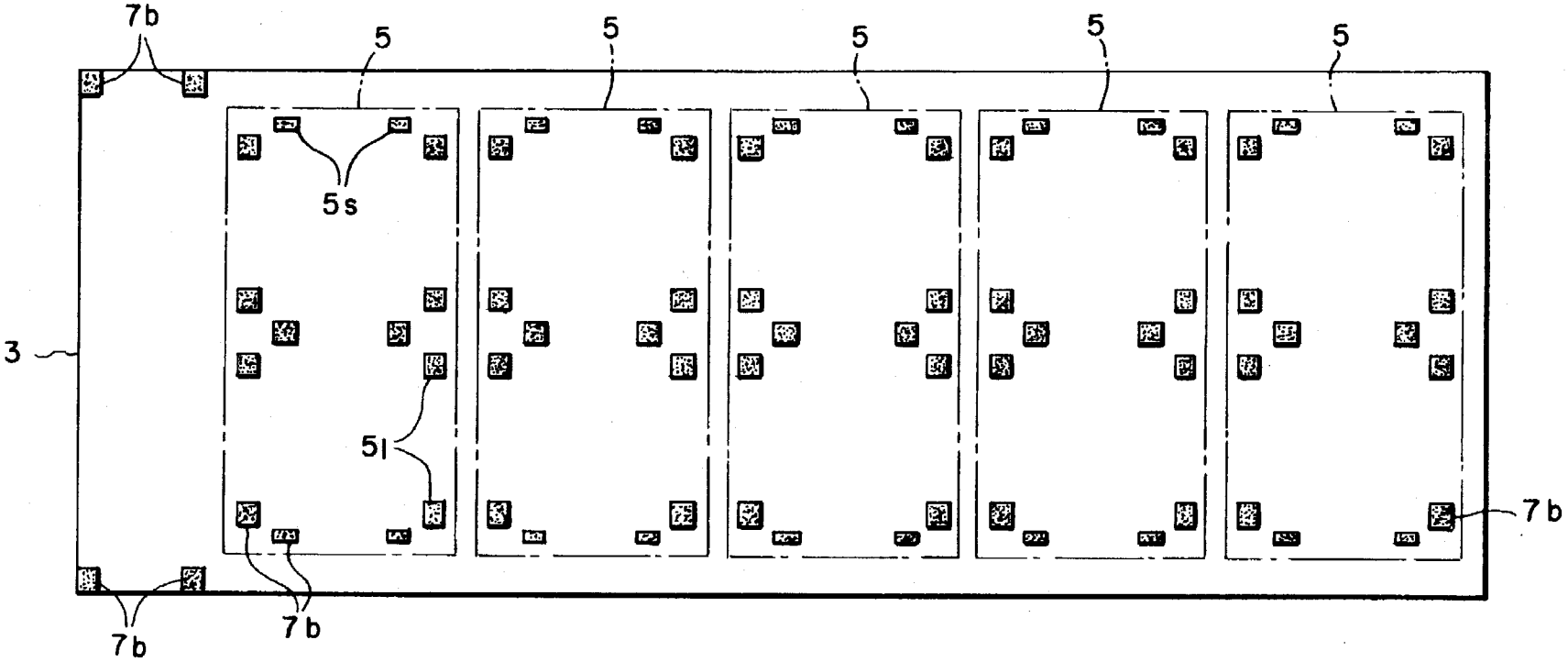
FIG. 5 is a frontal view of the display sign without posted information displayed.
Figure 4:
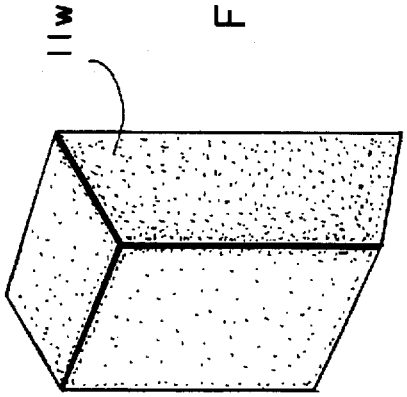
FIG. 4 is a perspective view of a wedge block shown in FIG. 8.

The background member 3 includes a number of alphanumeric representations 5 which provide a positional marking guide for the appropriate placement of the marking units 9 upon member 3. The sign 1, when adapted for use in advertising sales features for automobiles, boats and trucks, will usually have at least four and less than seven alphanumeric representations 5 and most preferably includes five representations 5. Each representation 5 is arranged upon the panel 3 face so that when filled completely with a full complement of marking units 9 will form a figure 8 configuration. The alphanumeric representations 5 are defined by a number of marking sites or marking guides which effectively define the appropriate emplacement for placing the marking units 9 upon the panel member 3 to form the desired numbering or alphanumeric posting. With particular reference to the middle alphanumeric representations 5 of FIGS. 5 and 6, it will be observed that the pairings designated as $5_l$ provide a marking guideline for separately emplacing marking unit segments $9_L$ onto representation 5 while the marking situs 5s pairings provide a marking guide or situs for affixing the marking unit 9s segments to background member 3. If, for example, it is desired to post the number 63850 as illustrated in FIG. 7, the six contrasting colored segments of the required marking units 9 to form the numbers 6 and 0 are separately emplaced upon each of the representations 5 at the appropriate marking situs $5_l$ or 5s of the panel 3. The five (5) segments of the legged unit 9 ($9_L$ and 9s) are required to form the numbers 3 and 5 while seven segments of legged unit 9 are needed to complete the number 8.

Figure 6:
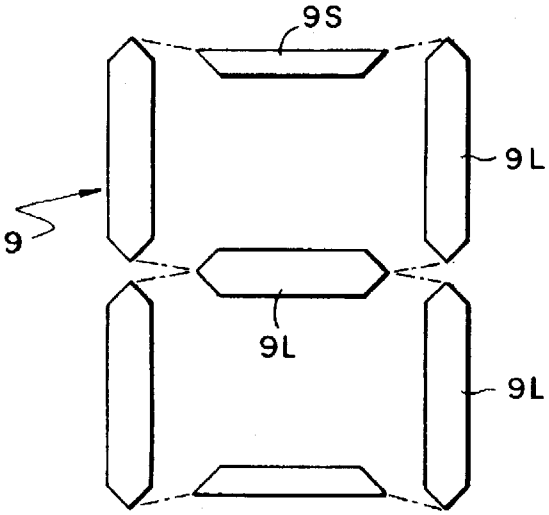
FIG. 6 is an isolated frontal view depicting seven segmented marking units of the sign arranged in an alphanumeric representation.

It will be observed from FIG. 6 that the marking units 9 illustratively designated as 9s are aesthetically sized smaller than those illustratively designated by $9_L$. The 9s marking unit designations are adapted for placement at the top and bottom of each of the representations 5. If desired all units 9 may be sized and configured alike or differently. As may be observed from FIG. 6, seven of the marking units 9 of a contrasting color are needed to complete a figure 8 of each of alphanumeric representations 5 while two marking units 9 are needed to post numeral one (1), three units 9 to post numeral seven (7), four units 9 to post the numeral four (4), and five units 9 to post the numerals two (2), three (3), five (5) and nine (9). Although the number six (6) may be depicted with five marking units 9, six marking units 9 are preferably used for this purpose as is also the case for posting the number zero (0).

The affixing or fastening means (generally designated as 7) includes a wide variety of fasteners for detachably fastening marking units 9 to panel member 3. Fastening means 7 which require a compressive pressure to adhere and a pulling apart force (e.g. force opposite to the comprehensive force) to detach are preferred. An illustrative fastening means 7 embodies fitting both the marking units 9 and the alphanumeric representations 5 with a hook and napped loop (respectively represented by a and b) fastener combination (e.g. VELCRO of VELCRO U.S.A., Inc.) such as disclosed in U.S. Pat. Nos. 2,717,437; 3,000,384; and 3,009,235. Such fastener combinations are commercially available in a tape form wherein the reverse tape surfaces from the napped or hooked projection includes a pressure sensitive cement adhesive for adhesively securing and bonding the respective fastening tapes onto the marking units 9 and panel 3 at the appropriate representation 5. As illustrated in FIGS. 1–5 and 7, a hooked tape portion thereof (suffixed as a) comprises a multitude of plastic hook projections (suffixed as b)which may be affixed to representations 5 and the plastic looped tape or napped strip (comprising a multitude of looped plastic projections) interfacingly being attached to marking unit 9 so as to correspondly register therewith. As typified by FIGS. 5–7, $5_l$ and 5s are equipped with either the interfacing hook 7a or loop 7b to match the interlocking and interfacing hook or loop patches 7a or 7b of segment $9_L$ or 9s so as to permit separate placement of each segment $9_L$ or 9s of the marking units 9 upon panel 3. Upon pressing the hooked strip a against the napped or looped plastic strip b together, the fastening combination becomes securely and firmly bound together until manually released. This particular fastening combination affords a means for securing marking units 9 to the representations 5 while also defining the alphanumeric representations 5 positioning upon member 3. The fastener combination a and b may easily be separated by pulling fastener strip a from the marking unit 9 away from the fastener strip b.

Figure 13:
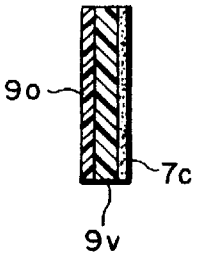
FIG. 13 is a cross-sectional view taken along line 13—13 of FIG. 12.
Figure 12:
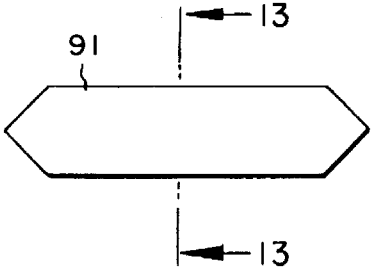
FIG. 12 is an isolated frontal view depicting a segmented marking unit placed in a middle position of an alphanumeric representation.
Figure 11:
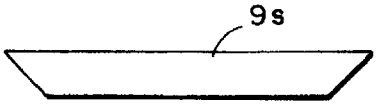
FIG. 11 is an isolated frontal view depicting a segmented marking unit placed in a top position of an alphanumeric representation.

In an alternative and preferred embodiment of the invention illustrated by FIGS. 11–13, marking units 9 (shown as 9s and 9l) may be equipped with a pressure sensitive material 7c (as illustrated in the cross-sectional view of 13) which, when pressed upon, representation 5 will become adheringly affixed to representation 5 but may be easily removed or separated simply by lifting marking unit 9 from the representation 5. For illustrative purposes, the cross-sectional view of FIG. 13 depicts a marking unit comprised of polyvinyl chloride film 9v of a contrasting color to background member 3 cut to the configuration of 9s and $9_L$ coated on one side of the marking unit 9 with a clear lamenated film 9o and upon an opposite marking unit 9 side with a pressure sensitive adhesive coating 7c, preferably with an ultra removable pressure sensitive adhesive which may be repeatedly applied and removed. When not in use, the unused marking units may be placed upon the backside of panel member 3. In the situations wherein an adhesively engaging marking unit 9 is affixed to the panel member 3, each representation 5 will preferably include a tracing or guidelines of a figure 8 configuration as illustrated by FIG. 10 to demark the appropriate placement of the marking units 9 thereupon.

Figure 2:
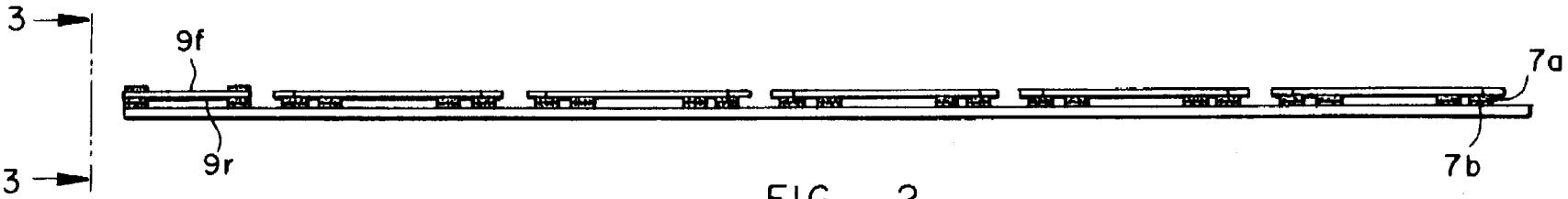
FIG. 2 is a bottom, side view of the display sign shown in FIG. 1.

In one of the embodiments of the invention, the marking units 9 exhibit a contrasting color to panel 3 on one marking face side 9f and a matching color to panel 3 on an opposite face side 9r (e.g. see FIGS. 7) to the marking face side. The marking units 9 may all be placed upon panel 3 with desired posting being achieved by placing the appropriate contrasting colored legged units 9 to create the desired number while the marking units 9 of a matching color to panel 3 being appropriately exhibited at the remaining postings of the representation 5. As illustrated in FIG. 2 the front face 9f and reverse side 9r of the marking units 9 are fitted with interlocking patches 7 for fastening units 9 to member 3. The interlocking patches 7a and 7b placed upon both faces (9f and 9r) of units 9 are of a coloring designed to match the unit 9 surface upon which they appear. Under these preferred embodiments of the invention, if it is desired to form the five digit alphanumeric representations 5 of FIG. 7, the appropriate contrasting colored facings 9f of marking units 9 to form the 63950 numbering are placed upon panel 3 with the opposite face 9r or reverse side of the marking units 9 which matches in color to panel 3 being emplaced upon the remaining securing sites of each representation 5.

Modern dry windshields T often embody a standard curvature designed to reduce wind resistance and protectively shield the occupants against glare. Such windshields T may create occlusion or distortion of imagery if the posting is placed at too great of a distance from the windshield T. Certain automobiles are also equipped with windshields T tinted or reflective to light so that if the posted message is not placed in close proximity to the windshield T it becomes obscured by the reflectiveness or tinting of the windshield T. As previously indicated, the panel member 3 is appropriately constructed of pliable materials which allow the panel member 3 to conform to the curvature of the windshield T and place the posted message in juxtaposition to inner windshield T surface. The biasing member 11 will preferably bias the panel member 3 against the windshield and biasingly conform the panel member 3 configuration to the inner contour of the windshield as illustrated by FIG. 8. Consequently, the panel member 3 and its posted message will be placed against the windshield W with the minimum level of distortion by the windshield T. Thus, message upon sign 1 may be easily observed and read by passersby.

Figure 14:
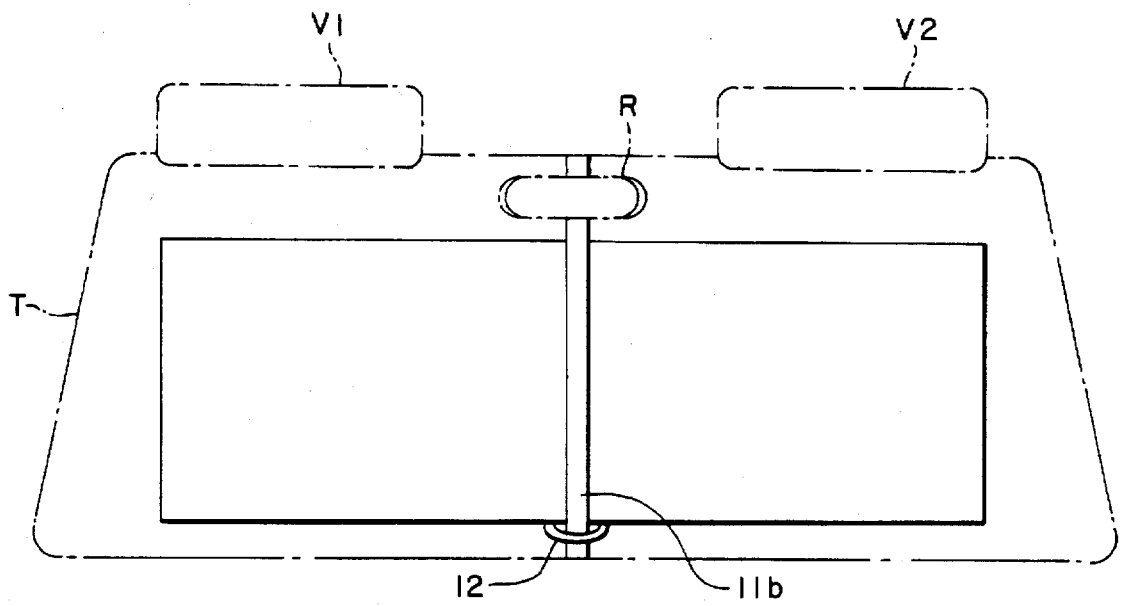
FIG. 14 is a rear view of the display sign of FIG. 1 biased against an automotive windshield with a biasing bar.
Figure 15:
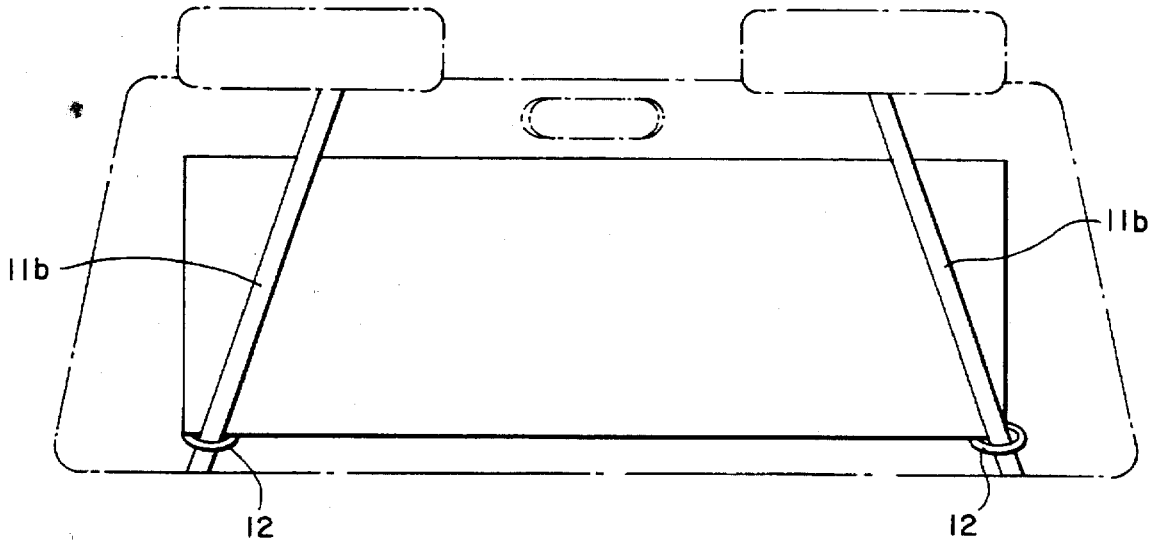
FIG. 15 is a rear view of the display sign of FIG. 1 biased against an automotive windshield with biasing bars.

As illustrated by the drawings, display sign 1 is particularly well-adapted for interiorly displaying the posted message P within a passenger compartment of a vehicle. A conventional vehicular dashboard 9, such as commonly present in automobiles and tracks, will typically extend widthwise along the entire base of windshield T. Effective biasing of background member 3 towards windshield T relies upon one or more anchoring sites for anchoring the biasing means 11 within the vehicle. Convenient anchoring sites include the dashboard D for biasingly anchoring the biasing wedge 11*w* thereto, the cornering edge margining onto a base section of windshield T and dashboard D, and an anchoring site placement between a visor (generally designated as V) and headliner H of a vehicle M. The use of these anchoring sites for anchoring biasing member to the vehicle V is illustrated by FIGS. 8, 14 and 15. The channeled region between the cornering edge of the windshield T and dashboard D provides a particularly well suited anchoring site for anchoring one end of a biasing bar 11*b* to a vehicle. If one biasing bar 11*b* is used, the rearview mirror R provides a suitable anchoring site for anchoring an opposite end of bar 11*b*. FIG. 15 depicts two biasing bars 11*b*. Placement of a bar 11*b* into the channel region between the dashboard D and windshield T and diagonally to an anchoring site beneath the passenger visor $V_2$ and driver visor $V_1$ provides an excellent anchoring and biasing system for one of the biasing bars. The dashboard D center provides an appropriate biasing position for biasing background member 3 against the vehicular windshield T. When a biasing bar 11*b* is used to bias member 3, dashboard D and mirror R may be effectively used to anchor biasing bar 11*b* in a biasing position as shown in FIG. 14.

The biasing of panel member 3 towards the windshield T relies upon at least one anchoring site in juxtaposition to the windshield T in order to permit the biasing member 11 to exert the biasing force towards the windshield T. When the biasing wedge 11*w* is used, the mirror may serve as an anchoring site for anchoring on the upper center portion of the panel member 3 towards windshield T while the dashboard serves as a biasing site for wedging wedge 11*w* against member 3. When the biasing member comprises a biasing bar, the open spaced zone between the windshield T and the dashboard D may serve as the bottom anchoring site while either the rearview mirror R or a padded visor V may serve as an anchoring site for biasing the upper portion of member 3 with the biasing bar or rod 11*b*.

The biasing bar 11*b* may be constructed of any suitable material (e.g. plastic, metal, wood, etc.) possessing sufficient flex and rigidity to exert a biasing force against member 3 when anchored between two anchoring positions in a flexed state as illustrated in the drawings. The biasing bar 11*b* may be of a stick, rod, staff, bar, pole, stave, etc. form of a length sufficient to extend across an upper portion and lower portion of the background member 3. Wood biasing bars constructed of Southern Pinewood measuring 36 inches by 1 inch by ⅛ inch thick may be effectively used for this purpose. The biasing bar 11*b* is sized at one end to be wedged between the base of the windshield T and the dashboard D. The anchoring of bar 11*b* between the dashboard and windshield T and either the rear mirror R or visor V causes the biasing bar 11*b* to bow and flex inward towards the windshield T, thereby biasing panel member 3 towards windshield T.

In the preferred embodiments of the invention, two biasing bars respectively anchored in a channel region abutting onto the windshield T and dashboard at a bottom region of member 3 and between the headliner and driver visor on one side of sign 1 and the headliner and passenger visor on the passenger sign side of the sign 1 serve to flushly bias the flexible member 3 onto the windshield T. The use of two biasing bars 11*b* is illustrated by FIG. 15.

In a further embodiment of the invention as illustrated by FIGS. 13 and 14, the biasing bars 11*b* are equipped with adjustable sign retaining units 12. The sign retaining units 12 serve to retainingly support member 3 with the retaining units being adjustably secured to bar 11*b*. The adjustable sign retaining units 12 (shown as snuggly fitting rings) may be adjusted upwardly or downwardly along bar 11*b* so as to permit proper positioning of sign 1. The adjustable retaining units 12 may be appropriately constructed of any protruding unit which may be adjustably secured along bar 11*b*. Pegs, pins or variable fasteners for holding sign 1 may be used for this purpose. Positioning rings constructed of an elastic (rubber rings) or inelastic material (vinyl rings) sized to snuggly circumscribe bar 11*b*, which may be slid up and down the bar 11*b* are particularly useful as retaining units. Plastic rings 12 (e.g. PVC, polyethylene, etc.) measuring from about ¼ inch to about ½ inch or more in width and a diameter of the same size as the bar width, compressed to an oblong shape and placed onto the bar 11*b* are particularly well suited for this purpose.

A biasing wedge 11*w* comprises a suitable biasing means for biasing the member 3 against the windshield T. The dashboard d provides the anchoring base for maintaining the wedge 11*w* in a wedging position as shown in FIG. 8. Sufficient frictional forces should exist between the interfacing surfaces of the wedge 11*w* and dashboard D to maintain the wedge 11*w* at a wedging or biasing position. Traction for maintaining the wedge 11*w* in the biasing or wedging position may be provided by the dashboard D, wedge 11*w* or by both. If desired, the wedge 11*w* may be provided with a tractive surface such as a fine plastic grit so as to not damage the dashboard D, a rubber-soled interfacing surface, adhesive surface or any other appropriate tractive surface so as to positionally maintain the wedge 11*w* upon the dashboard D at a wedging position. A preferred embodiment of the invention relies upon resiliency within the dashboard D or the wedge 11*w* to create the biasing forces to positionally maintain the wedge 11*w* at the wedging position. A relatively solid and inflexible biasing wedge 11*w* may be used upon those dashboards which contain sufficient resilient padding to exert a resilient force against the wedge 11*w* once it is placed in the wedging position.

In the preferred embodiments of the invention, the biasing wedge 11*w* is constructed of a resilient material (e.g. natural and synthetic rubber, foamed resilient plastic materials such as a polyurethane, etc.) which, when compressed at a biasing position between the panel member 3 and the dashboard D, exerts a multi-directional decompressing biasing force against the dashboard D and the panel member 3. The windshield T and the dashboard D provide the anchoring points against which the decompressing forces of the resilient material exerts the biasing forces. Wedging blocks 11*w* fitted with springs and tractive surfaces so as to exert directionally opposing forces (i.e. one force in direction of the windshield and another in direction of the dashboard) may be utilized to firmly wedge sign 1 against windshield T. Most preferably, the biasing wedge 11*w* is constructed of resilient material of sufficient firmness to maintain its wedging position with sufficient resiliency to exert diametrically opposing forces against the dashboard D and the background member 3 when properly positioned between the dashboard D and windshield T. A hard rubber stock (e.g. tire stock) or core material surfaced with a hard rubber stock may be used for this purpose. A particularly useful material for fabricating the wedging blocks 11*w* comprises a closed-cell crosslinked polyethylene, polyethylene/EVA foam with an extremely fine cellular structure which is commercially available as SENTINEL MICROCELL MC1900 manufactured and distributed by Sentinel Products Corp., 70 Airport Road, P.O. Box 5, Hyannis, Mass. 02601. Microcell is available in 48"×72", 54"×96" and 60"×96" buns in both 3" and 4" thicknesses. The wedges must then be cut from this material.

The background member 3 will most suitably possess sufficient rigidity (with sufficient flexibility to conform to the windshield curvature) so as to permit the biasing member 11, such as a single biasing wedge 11*w* to flushly position the sign against the windshield T. If less rigid materials are used to fabricate the background member 3, two or more biasing members 11*w* may be needed to bias the sign flushly against the windshield T. As may be further observed from FIGS. 4 and 8, the biasing wedge 11*w* may be provided with a multiple of differing angular faced slopes so as to allow the wedge 11*w* to be more uniformly used to match the diverse angular dispositions between the windshield T and the dashboard D of different vehicles. Thus, by cutting different sloped planes onto the polynominally faced cube, wedging angles to conform wedge 11*w* to the particular angular disposition of the dashboard D and windshield T of any particular vehicle may be achieved accordingly.

FIGS. 14 and 15 depict the use of one or more biasing bars 11*b* to bias the conformable panel member 3 against the windshield T. The mirror m and the forward portion of dashboard d provide anchoring positions for bar 11*b*. In general, bar 11*b* should be constructed of a material having a sufficient biasing leverage to bias the conformable member 3 against windshield T. In order to prevent damage, biasing bar 11*b* should be constructed or surfaced with a non-damaging construction. Protectively coated metal and spring bars, plastic and rubber wedging bars, and wooden rods or bars are exemplary materials which may be effectively used for this purpose. A wooden slat such as a yard stick constructed of pine wood stock measuring 36"×1⅛" has been found particularly effective as a biasing bar 11*b*.

Figure 1:
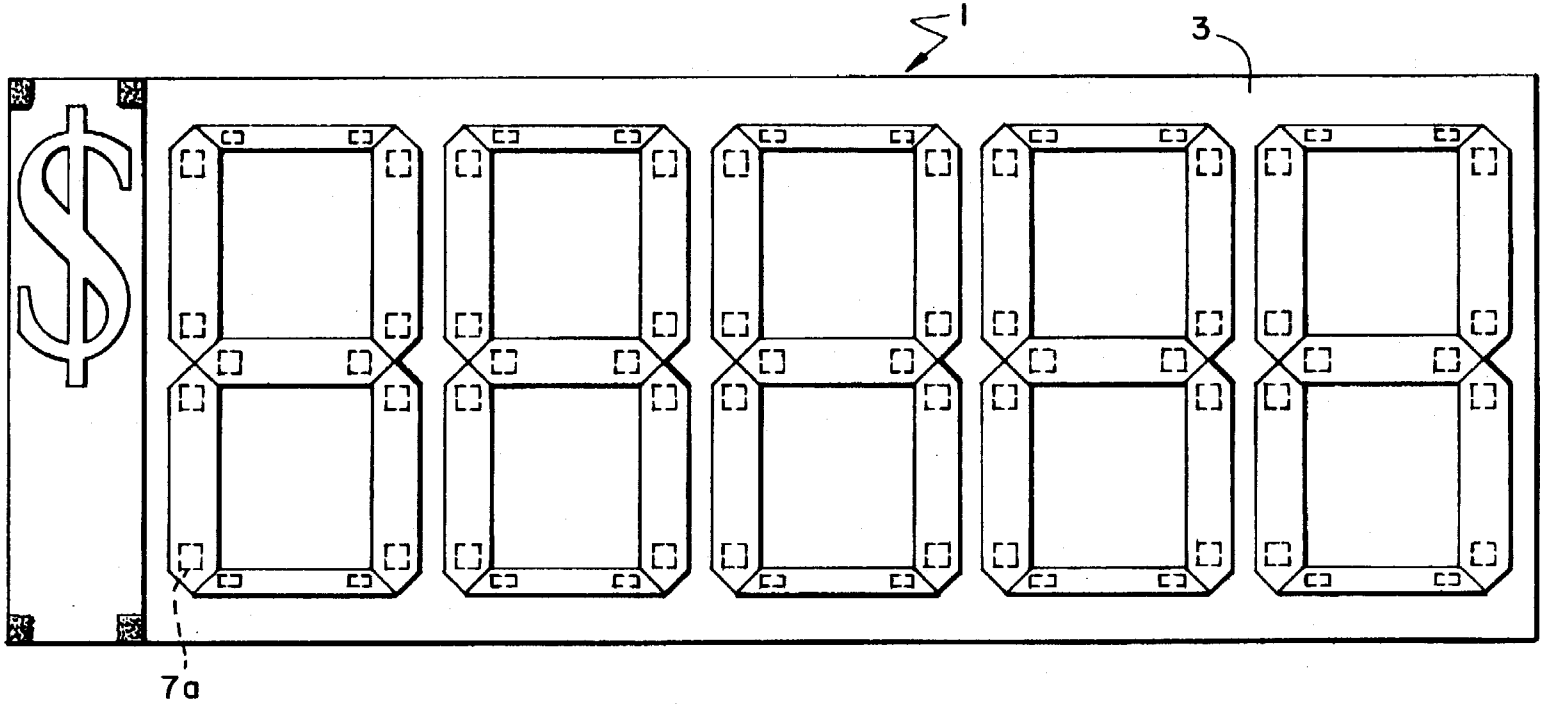
FIG. 1 is a frontal view of the display sign of this invention showing alphanumeric representations.
Figure 3:
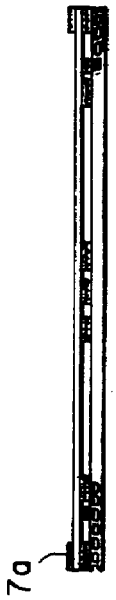
FIG. 3 is a cross-sectional view taken along 3—3 of FIG. 2.

The display sign 1 itself may serve to stow the full compliment of needed marking units 9 required for the alphanumeric representations 5. Stowing may be accomplished upon the face of the sign 1 as illustrated by FIGS. 1–3 or similarly upon the backside of sign 1 (not shown). Accordingly, unneeded marking units 9 may be stored upon the sign face by having one marking unit 9 face of a matching color and an opposite marking unit 9 face of a contrasting color to the background member 3. Both of the faced surfaces of marking units 9 and representations 5 may be equipped with corresponding interlocking patches 7 (e.g. interfacing hook a and loop b patches) for interfacially securement mating upon the background member 3. Thus, by posting the desired numbering with the appropriate contrasting colored marking units 9 at each representation 5 while leaving the non-contrasting colored side of the marking units 9 at the remaining alphanumeric situs, all of the marking units 9 required to mark any desired integer for each of the representations 5 may thereby be stored upon the face of the display sign 1. Alternatively, the backside of member 3 may be appropriately provided with an interlocking patch for marking unit 9 which permits the unused marking units to be thereby stowed upon backside of member 3 when not used. In the case where self-adhering marking units 9 are used, the unused marking units 9 may be affixed to the backside of member 3.

The sign 1 is particularly adapted for use within a vehicular interior. The component elements of sign 1 are of construction and design so as not to cause damage or marring to the vehicle's interior. Thus, the sign even when carelessly removed and thrown about the interior of the automobile will not result in damage to the delicate interior fixtures. Construction of the sign components of non-metallic materials and especially those of polymeric materials (e.g. thermoset, thermoplastic, rubbers, etc.) may be effectively used for this purpose.

As evident from the aforementioned teachings, the message upon the display sign 1 may be readily changed to any other desired message. Prices or any other desired letters or numbers for any given vehicle may be readily changed to reflect a variety of sales messages. The display sign 1 may be constructed of relatively inexpensive components which may be repeatedly reused when changing messages. Consequently, the maintenance and labor costs are nominal and especially when compared to current display signs and practices.

The display sign 1 is designed to be placed flushly interiorly against an automotive windshield. Consequently, damages due to weathering and external damaging such as by vandalism, ice scrapping, UV light, etc, are alleviated by the unique embodiments of this invention. Compliance with statutory requirements that vehicles must be free from view obstructing objects when highway driven may be readily complied with by simply removing the display sign 1 from the windshield T when test driving the vehicle and reinstalling the display sign 1 against the windshield T after the test drive. Equally important is the unique feature of being able to place the sign 1 with a message flushly against the windshield T so that it may be readily discerned by passersby. Furthermore, the retaining units provide the added benefit of positioning sign 1 at the appropriate position for display. For example, where the top of a windshield T is tinted, the sign 1 may be retainingly lowered so as to be viewed through the non-tinted portion of the windshield T.

The present invention also provides a unique method for posting and removing a display sign 1 composed of changeable alphanumeric indicia using seven segments 9 for forming a figure 8 configuration and adapted for use in displaying sales information against a transparent surface T, said sign 1 comprising a flexible background member 3 having a number of alphanumeric representations 5 displayed thereupon, a plurality of the alphanumeric indicia 9 for posting upon said alphanumeric representation 5, said indicia individually comprising a segmented unit 9 of a contrasting facial color to said background member 3, said unit 9 when combined with a multiplicity of said indicia 9 providing the changeable alphanumeric indicia 9 of the figure 8 configuration for posting the information upon said background member, affixing means 7 for posting the multiplicity of the indicia upon the background member 3 at the alphanumeric representations 5 so as to permit the alphanumeric indicia 9 upon the sign to be altered and biasing means 11 for biasing the pliable background member 3 against the transparent curved surface T so as to conform the background member 3 to the contour of the curved surface T, said method comprising:

a) posting the indicia 9 upon the background member 3 to display the sales information thereupon;

b) positioning the display sign 1 in juxtaposition to the transparent surface; and c) retaining the flexible background member 3 in juxtaposition to said transparent surface by retainingly biasing said member 3 onto said transparent surface.

The method of using sign 1 alleviates the expenses and extensive work normally associated with conventional signs and their use. The sign 1 is protectively removed from environmental and vandal associated damages. Costly repainting or decaling is avoided since the sign 1 may be expeditiously placed in a rear seat or trunk for test driving and reposted upon return. The posted message may be readily changed simply by posting the appropriate marking units 9 upon the panel member 3.

What is claimed is:

1. A display sign for displaying alphanumeric messages of a figure 8 configuration within a motorized transport equipped with a windshield, a dashboard, a cornering biasing edge disposed between a base section of the windshield and the dashboard, and upper anchoring sites in juxtaposition to an upper section of the windshield, said display sign comprising a flexible panel member, a multiplicity of segmented marking units of a contrasting color affixed to said panel member, a number of alphanumeric representations displayed upon the panel member for affixing said marking units thereto, and detachable pressure sensitive affixing means for affixing the marking units to the representations and flexible biasing members comprised of a pair of biasing bars sized to biasingly bridge between the base section and the upper anchoring sites for biasing the panel member towards the windshield, with each of said pair of biasing bars being equipped with an adjustable panel member positioning unit upon which the panel member may be placed and elevationally adjusted to a desired sign positioning placement thereupon.

2. The sign according to claim 1 wherein the flexible panel member comprises a corrugated plastic panel board.

3. The sign according to claim 1 wherein the marking units are sized so as to require seven separate placements of the marking units upon one of the alphanumeric representations to form the figure 8 configuration thereupon.

4. The sign according to claim 1 wherein the marking units contain a detachable pressure sensitive adhesive coating which allows the marking units to be affixed to the representations and detachably removed from the representations.

5. The sign according to claim 1 wherein the biasing member comprises a biasing bar sized to anchor to the cornering edge and the upper anchoring site and bias the member towards the windshield.

6. A method for posting a changeable alphanumeric message upon a display sign against a transparent surface of a vehicle equipped with a windshield, a dashboard, and lower biasing sites located along a cornering edge disposed between a base section of the windshield and the dashboard, and upper anchoring sites located in juxtaposition to an upper section of the windshield, said sign comprising a flexible background member having a number of alphanumeric representations displayed thereupon, a plurality of the alphanumeric marking units of a contrasting color to said background member for placement upon said alphanumeric representations so as to permit the marking units to be detachably rearranged upon the representations and thereby change the message, and flexible biasing means comprised of a pair of biasing bars sized to biasingly bridge between the base section and the upper anchoring site for biasing the flexible background member towards the transparent surface, with each of said pair of biasing bars being equipped with an adjustable panel member positioning unit upon which the panel member may be placed and elevationally adjusted to a desired sign positioning placement thereupon, said method comprising:

a) affixing the marking units upon the representations to display the changeable alphanumeric message thereupon;

b) positioning the display sign by adjusting the positioning unit of each of said biasing bars to the desired sign placement for viewing through the transparent surface;

c) placing the biasing bars at the lower biasing sites and the upper anchoring sites; and d) biasing the biasing bars against the lower biasing sites and the upper anchoring sites so as to conformingly bias the flexible background member towards said transparent surface with said biasing bars.

7. The method according to claim 6 wherein the message is displayed against the transparent surface of a windshield within a motorized vehicle equipped with a rearview mirror in juxtaposition to the upper section of the windshield which serves as the upper anchoring sites for said biasing bars, and the method comprises anchoring the biasing bars against said upper biasing sites and said lower biasing sites and the biasing of the flexible member with said biasing bars towards said windshield.

8. The method according to claim 7 wherein the biasing bars are sized to biasingly extend between the upper biasing sites and the lower biasing sites; and the adjustable positioning unit comprises a slideably adjustable sign positioning unit for elevationally supporting the background member at a desired display position, and wherein the positioning includes slideably adjusting the positioning unit to the desired display position and thereafter biasing the background member towards said windshield with said biasing bars.

9. The method according to claim 6 wherein the biasing bars comprise a first biasing bar sized to biasingly extend from a first cornering edge of the windshield to a first sun visor site as first biasing sites for biasing said first bar therebetween, and a second biasing bar sized to biasingly extend from a second cornering edge of the windshield to a second sun visor site as second biasing sites for biasing said second bar, with said first bar and said second bar respectively including a first slideably adjustable sign positioning unit and a second slideably adjustable sign positioning unit and wherein the positioning includes respectively slideably adjusting the first positioning unit and the second positioning unit so as to display the message at a desired display position within the windshield, and the biasing includes biasing said first bar between said first biasing sites and the biasing of said second bar between said second biasing sites so as to conformingly bias said flexible member against said windshield.

10. The method according to claim 6 wherein the method includes the sequential step of removing the display sign from the windshield and thereafter reinserting the display sign by repeating steps of subparagraphs a, b, c and d of claim 16.

* * * * *